US011339530B2

(12) United States Patent
Meguro et al.

(10) Patent No.: US 11,339,530 B2
(45) Date of Patent: May 24, 2022

(54) NAPPED ARTIFICIAL LEATHER, POLYESTER FIBER, AND NON-WOVEN FABRIC

(71) Applicant: KURARAY CO., LTD., Kurashiki (JP)

(72) Inventors: Masashi Meguro, Okayama (JP); Hitoshi Nakatsuka, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 333 days.

(21) Appl. No.: 16/346,742

(22) PCT Filed: Nov. 29, 2017

(86) PCT No.: PCT/JP2017/042889
§ 371 (c)(1),
(2) Date: May 1, 2019

(87) PCT Pub. No.: WO2018/110280
PCT Pub. Date: Jun. 21, 2018

(65) Prior Publication Data

US 2020/0056329 A1 Feb. 20, 2020

(30) Foreign Application Priority Data

Dec. 13, 2016 (JP) ..... JP2016-241291

(51) Int. Cl.
*D06N 3/00* (2006.01)
*D06N 3/14* (2006.01)

(52) U.S. Cl.
CPC ..... *D06N 3/0075* (2013.01); *D06N 3/0011* (2013.01); *D06N 3/0036* (2013.01); *D06N 3/14* (2013.01); *D06N 2211/28* (2013.01)

(58) Field of Classification Search
CPC ..... D06N 3/0075; D06N 3/14; D06N 3/0036; D06N 3/0011; D06N 3/0002; D06N 3/0004; D06N 2211/28; C08G 63/60–605; C08G 63/127; C08G 63/181–183; C08L 67/02; C08L 2205/02; C08L 2205/025
See application file for complete search history.

(56) References Cited

U.S. PATENT DOCUMENTS 4,564,658 A * 1/1986 Liu ..... C08L 67/02 524/504
4,604,320 A 8/1986 Okamoto et al.
6,623,681 B1 * 9/2003 Taguchi ..... D01F 6/62 264/211.15
8,772,420 B2 * 7/2014 Drysdale ..... C08G 63/6826 570/127
2004/0157037 A1 * 8/2004 Yamaguchi ..... B32B 5/26 428/91
2012/0156416 A1 6/2012 Yanagisawa et al.
2013/0187367 A1 * 7/2013 Kim ..... D06N 3/0068 280/743.1
2015/0050460 A1 2/2015 Fujisawa et al.
2018/0066397 A1 3/2018 Murate et al.

FOREIGN PATENT DOCUMENTS

| | | | |
|---|---|---|---|
| CN | 1092722 | C | 10/2002 |
| CN | 1469003 | | 1/2004 |
| JP | 2004-162244 | A | 6/2004 |
| JP | 2006-45723 | | 2/2006 |
| JP | 4074377 | B2 | 4/2008 |
| JP | 2012-136800 | A | 7/2012 |
| JP | 2013-67917 | A | 4/2013 |
| JP | 2013-194327 | A | 9/2013 |
| JP | 2014-231650 | A | 12/2014 |
| TW | 201641778 | | 12/2016 |
| WO | WO 2011/027732 | A1 | 3/2011 |
| WO | WO 2013/065608 | A1 | 5/2013 |

OTHER PUBLICATIONS

Schwartz, Mel. (2016). Encyclopedia and Handbook of Materials, Parts, and Finishes (3rd Edition)—Tenacity. Taylor & Francis. Retrieved from https://app.knovel.com/hotlink/pdf/id:kt011YT0F1/encyclopedia-handbook/tensile-strength (Year: 2016).*
Extended European Search Report dated Jul. 22, 2020 in European Application No. 17880102.3.
International Search Report dated Jan. 30, 2018 in PCT/JP2017/042889 filed Nov. 29, 2017.

* cited by examiner

*Primary Examiner* — Larissa Rowe Emrich
(74) *Attorney, Agent, or Firm* — Grüneberg and Myers PLLC

(57) ABSTRACT

Disclosed is a napped artificial leather including: an artificial leather base material that includes a non-woven fabric of polyester fibers having a Young's modulus of 1 to 6 GPa, an average fiber-toughness of 8 to 40 cN·%, and a crystallinity of 35% or less, and an elastic polymer, the artificial leather base material having, on at least one surface thereof, a napped surface on which the polyester fibers are napped. Also disclosed are polyester fibers having a Young's modulus of 1 to 6 GPa, an average fiber-toughness of 8 to 40 cN·%, and a crystallinity of 35% or less, and a non-woven fabric including the polyester fibers.

6 Claims, No Drawings

NAPPED ARTIFICIAL LEATHER, POLYESTER FIBER, AND NON-WOVEN FABRIC

TECHNICAL FIELD

The present invention relates to a napped artificial leather for use as a surface material for clothing, shoes, articles of furniture, car seats, general merchandise, and so forth, and polyester fibers and a non-woven fabric.

BACKGROUND ART

Conventionally, napped artificial leathers such as a suede-like artificial leather and a nubuck-like artificial leather are known. The napped artificial leather has a napped surface formed by napping the fibers on the surface of an artificial leather base material including a non-woven fabric that has been impregnated with an elastic polymer. The napped artificial leather may exhibit a low-quality appearance, also called sharp bending in which the artificial leather bents at a sharp angle as a result of an angled edge formed along the bent portion of the artificial leather. In addition, the napped artificial leather may have a nonuniform napped surface, and exhibit a rough appearance with density unevenness.

As a technique for improving the appearance of the napped artificial leather, PTL 1 below discloses a polyurethane-containing artificial leather that contains ultrafine fibers and a polyurethane having the moduli of elasticity at 90° C. and 160° C. being within a certain range. PTL 2 below discloses a sheet-like material that contains two water-dispersible polyurethanes inside a fibrous base material of ultrafine fibers, and a portion of the water-dispersible polyurethanes has an amide bond and is locally attached to the outer circumference of a bundle of the ultrafine fibers, and the rest of the water-dispersible polyurethanes is a polycarbonate-based polyurethane. Also, PTL 3 below discloses a nanofiber aggregate having a single yarn fineness of $1\times10^{-7}$ to $2\times10^{-4}$ dtex.

The artificial leather described in PTL 1 is flexible, but has poor fiber seizability, posing the problem that the artificial leather has a poor surface appearance when it is provided with a suede-like finish. The sheet-like material described in PTL 2 requires a complicated production process because the two water-dispersible polyurethanes are contained, resulting in the problem of low productivity. The nanofiber aggregate described in PTL 3 is excellent in flexibility, but has the problem that the nanofibers have a low strength.

CITATION LIST

Patent Literatures

[PTL 1] Japanese Patent No. 4074377
[PTL 2] WO2013/065608 pamphlet
[PTL 3] Japanese Laid-Open Patent Publication No. 2004-162244

SUMMARY OF INVENTION

Technical Problem

It is an object of the present invention to provide a napped artificial leather that is less likely to undergo low-quality "sharp bending" in which the artificial leather bends at a sharp angle as a result of an angled edge formed when being bent, thus forming a projection, and that has a uniform and elegant appearance, and it is also an object thereof to provide flexible polyester fibers.

Solution to Problem

An aspect of the present invention is directed to a napped artificial leather including: an artificial leather base material that includes a non-woven fabric including polyester fibers having a Young's modulus of 1 to 6 GPa, an average fiber-toughness of 8 to 40 cN·%, and a crystallinity of 35% or less, and an elastic polymer contained in voids of the non-woven fabric, the artificial leather base material having, on at least one surface thereof, a napped surface on which the polyester fibers are napped. In production of a napped artificial leather, polyester fibers on the surface of an artificial leather base material including a non-woven fabric and an elastic polymer are napped by buffing. When the polyester fibers have high tenacity, the polyester fibers napped on the surface of the artificial leather base material cannot be easily cut by buffing, and thus tend to be long. In that case, the napped polyester fibers tend to gather, resulting in a rough, low-quality appearance with density unevenness. In general, as the thickness of polyester fibers increases, the polyester fibers become more difficult to be cut, and thus have increased mechanical strength, and also better color development by dyeing. On the other hand, when the thickness of polyester fibers is large, the polyester fibers become hard, and thus are difficult to provide a flexible texture. When polyester fibers are hard, they tend to form an artificial leather that has no suppleness and tends to undergo sharp bending in which the artificial leather bends at a sharp angle when being bent, thus forming a projection. With the napped artificial leather according to the present invention, it is possible to obtain a napped artificial leather having a flexible texture that does not cause sharp bending when the artificial leather is bent, and a uniform and elegant appearance, by adjusting the fiber-toughness, the Young's modulus, and the crystallinity. Preferably, the polyester fibers have an average fiber-toughness of 8 to 40 cN·%, since fibers do not become too hard, and it is possible to achieve a uniform and elegant appearance in which the polyester fibers on the surface are appropriately laid down. That is, with a napped artificial leather including a non-woven fabric of the above-described polyester fibers, it is possible to obtain a napped artificial leather having a flexible appearance, and an excellent texture achieved as a result of appropriately short napped fibers being formed by buffing due to the brittleness of the polyester fibers. Note that the fiber-toughness is an index indicating the tenacity and the level of rigidity per one fiber.

Preferably, the polyester fibers contain a polymer alloy resin of two or more polyesters having copolymer compositions different from each other, since polyester fibers having a Young's modulus of 1 to 6 GPa, an average fiber-toughness of 8 to 40 cN·%, and a crystallinity of 35% or less can be easily obtained. As the polymer alloy resin, it is preferable to contain a modified polyester containing an isophthalic acid unit and a terephthalic acid unit as acid-based monomer units, and a butane diol unit and a hexane diol unit as diol-based monomer units.

Preferably, the polyester fibers have a compressive force, as determined when 69120 fibers of the polyester fibers are compressively deformed by 1.0 mm in a compressive force measurement using a digital force gage, of 15 N or less, since flexible polyester fibers can be obtained.

Preferably, the napped surface has an arithmetic mean height (Sa), as determined in a surface roughness measurement in accordance with ISO 25178, of 30 μm or less in a grain direction, since the polyester fibers that move freely as a result of the napped surface being rubbed are short, so that a uniform appearance with a wet touch and low density unevenness can be obtained.

Another aspect of the present invention is directed to polyester fibers having a Young's modulus of 1 to 6 GPa, an average fiber-toughness of 8 to 40 cN·%, and a crystallinity of 35% or less, or a non-woven fabric including the polyester fibers. By adjusting the fiber-toughness, the Young's modulus, and the crystallinity of the polyester fibers in a predetermined range, it is possible to obtain flexible polyester fibers. Specifically, flexible polyester fibers can be obtained when the polyester fibers have a Young's modulus of 1 to 6 GPa and an average fiber-toughness of 8 to 40 cN·%.

Advantageous Effects of Invention

According to the present invention, a napped artificial leather that retains a flexible texture that is less likely to cause sharp bending when the artificial leather is bent, and a uniform and elegant appearance, and flexible polyester fibers can be obtained by adjusting the fiber-toughness, the Young's modulus, and the crystallinity of polyester fibers in a certain range.

DESCRIPTION OF EMBODIMENT

Hereinafter, an embodiment of polyester fibers according to the present invention and a napped artificial leather including the polyester fibers will be described.

The polyester fibers according to the present embodiment are polyester fibers having a Young's modulus of 1 to 6 GPa, an average fiber-toughness of 8 to 40 cN·%, and a crystallinity of 35% or less. The napped artificial leather according to the present embodiment is a napped artificial leather including: an artificial leather base material that includes a non-woven fabric of polyester fibers having a Young's modulus of 1 to 6 GPa, an average fiber-toughness of 8 to 40 cN·%, and a crystallinity of 35% or less, and an elastic polymer applied in voids of the non-woven fabric, the artificial leather base material having, on at least one surface thereof, a napped surface on which the polyester fibers are napped.

The polyester fibers can be obtained by performing melt spinning while adjusting the monomer composition that forms the polyester resin or preparing a polymer alloy resin by melt-kneading a combination of two or more modified or unmodified polyester resins such that the Young's modulus is 1 to 6 GPa, the average fiber-toughness is 8 to 40 cN·%, and the crystallinity is 35% or less. The napped artificial leather is an artificial leather obtained by buffing polyester fibers on the surface of an artificial leather base material including a non-woven fabric of polyester fibers and an elastic polymer impregnated into the non-woven fabric.

The Young's modulus of the polyester fibers is 1 to 6 GPa, and is preferably 2 to 5 GPa. When the Young's modulus of the polyester fibers exceeds 6 GPa, the polyester fibers become difficult to be deformed, thus resulting in a low-quality texture that is likely to cause the so-called buckling wrinkles, with which the polyester fibers and the non-woven fabric of polyester fibers sharply bend without flexibly bending when they are bent. When the Young's modulus is less than 1 GPa, the polyester fibers become too soft, so that the shape retainability of a non-woven fabric and a napped artificial leather obtained using the polyester fibers tends to be reduced.

Note that the fiber-toughness is a tensile toughness per one fiber that can be calculated as described below, and is an index indicating the tenacity and the level of rigidity per one fiber. The average fiber-toughness of the polyester fibers according to the present embodiment is preferably 8 to 40 cN·%, more preferably 10 to 30 cN·%. When the fiber-toughness is in such a range, the tenacity of the fibers will not become too high. Accordingly, the polyester fibers on the surface are appropriately cut by buffing performed in the production process of the napped artificial leather, and thus are shortened uniformly. As a result, the napped polyester fibers are less likely to gather, so that a moist touch can be provided. When the average fiber-toughness exceeds 40 cN·%, the fibers become difficult to be cut by buffing. Then, the lengths of the napped polyester fibers nonuniformly increase, so that the fibers are likely to gather. This results in a napped artificial leather having a nonuniform, low-quality appearance with a rough dry touch and density unevenness. On the other hand, when the average fiber-toughness is less than 8 cN·%, the mechanical properties of the polyester fibers are reduced.

The crystallinity of the polyester fibers is 35% or less, and is preferably 32% or less, more preferably 30% or less. When the crystallinity exceeds 35%, the polyester fibers tend to be rigid and brittle. The lower limit of the crystallinity is, but is not particularly limited to, preferably 20%, more preferably 22%. Note that the crystallinity as used herein is a value obtained by measuring the quantity of heat of fusion ΔH (kJ/g) with a differential scanning calorimeter (DSC), and calculating the crystallinity by the following equation, using the quantity of heat of fusion of a fully crystallized PET 26.9 kJ/mol (Polymer Data Handbook).

$$\text{Crystallinity}=\Delta H/26.9\ (\text{kJ/g})/192\ (\text{g/mol})\times 100(\%)$$

The polyester fibers according to the present embodiment are polyester fibers having a Young's modulus of 1 to 6 GPa, an average fiber-toughness of 8 to 40 cN·%, and a crystallinity of 35% or less. Such polyester fibers may be made of one polyester resin composed of monomer units that have been prepared so as to satisfy the above-described properties, or may be a polymer alloy resin obtained by melt-kneading a combination of two or more modified or unmodified polyester resins having monomer units different from each other. Among these, a polymer alloy resin including a combination of two or more polyester resins is preferable since polyester fibers having the above-described properties can be easily prepared.

As described above, the polyester fibers according to the present embodiment are flexible fibers, and because of their softness, can be easily deformed with a small force when compressed in the transverse cross-sectional direction, for example. Specifically, the polyester fibers have a compressive force, as determined when 69120 fibers of the polyester fibers are compressively deformed by 1.0 mm in a compressive force measurement using a digital force gage capable of measuring the force required to compressively deform a substance by a certain amount, of preferably 15 N or less, more preferably 10 N or less, since polyester fibers that have excellent flexibility and are easily deformed can be obtained.

Specific examples of the unmodified polyester resins include polyethylene terephthalate (PET), polytrimethylene terephthalate (PTT), and polybutylene terephthalate.

A modified polyester resin is a polyester resin obtained by substituting at least a portion of an ester-forming acid-based monomer unit or diol-based monomer unit of an unmodified polyester resin with a monomer unit capable of substituting these units. Specific examples of the modified monomer unit capable of substituting the acid-based monomer unit include units derived from an isophthalic acid, a sodium sulfoisophthalic acid, a sodium sulfonaphthalene dicarboxylic acid, an adipic acid, and a dibutyl phosphate that are capable of substituting a terephthalic acid unit. Specific examples of the modified monomer unit capable of substituting a diol-based monomer unit include units derived from diols, such as a butane diol and a hexane diol, that are capable of substituting an ethylene glycol unit.

In the present embodiment, the polyester fibers that satisfy the above-described properties are formed by the modified polyester resin as described above, or a polymer alloy resin including a combination of two or more modified or unmodified polyester resins. Note that the types of resins are not particularly limited, so long as the above-described properties can be achieved. Since the above-described properties are dependent not only on the monomer composition, but also on the melt viscosity corresponding to the degree of polymerization and also on the fineness, the polyester fibers may be produced by appropriately adjusting these values.

The average fineness of the polyester fibers is preferably 0.01 to 0.5 dtex, more preferably 0.05 to 0.45 dtex, particularly preferably 0.1 to 0.4 dtex. When the average fineness of the polyester fibers is too high, the rigidity of the fibers becomes too high, so that the napped polyester fibers are likely to be raised by friction, and tend to result in a dry touch. When the average fineness of the polyester fibers is too low, the color development during dyeing tends to be reduced. In the case where a non-woven fabric or an artificial leather is produced, the average fineness is calculated using the densities of the resins that form the fibers and the average value of diameters of fibers. The diameters are determined by imaging a cross section of the non-woven fabric or the artificial leather that is parallel to the thickness direction thereof using a scanning electron microscope (SEM) at a magnification of 3000×, and calculating as the average value evenly selected 15 fibers.

The napped artificial leather according to the present embodiment includes a non-woven fabric of polyester fibers having a Young's modulus of 1 to 6 GPa, an average fiber-toughness of 8 to 40 cN·%, and a crystallinity of 35% or less, and an elastic polymer impregnated into the non-woven fabric. As the elastic polymer impregnated into the non-woven fabric of polyester fibers, an elastic polymer that has been conventionally impregnated into a non-woven fabric in the production of an artificial leather can be used without any particular limitation. Specific examples thereof include elastic bodies such as polyurethane, an acrylic resin, an acrylonitrile resin, an olefin resin, and a polyester resin. Among these, polyurethane is preferable.

The content ratio of the elastic polymer is preferably 0.1 to 60 mass %, more preferably 0.5 to 50 mass %, particularly preferably 1 to 30 mass %, relative to the mass of the polyester fibers, in terms of the good balance between the fullness and suppleness or the like of the napped artificial leather. When the content ratio of the elastic polymer is too high, the resulting napped artificial leather tends to be rubber-like and hard. When the content ratio of the elastic polymer is too low, the fibers are likely to be pulled off from the napped surface by friction, so that the fibers tend to be easily raised by friction.

By buffing the surface of the artificial leather base material including the non-woven fabric of polyester fibers and the elastic polymer, a napped artificial leather base material having a surface layer on which polyester fibers are napped is obtained. Napping is performed by buffing the surface using sand paper or emery paper with a grit number of preferably about 120 to 600, more preferably about 320 to 600. Thus, a napped artificial leather base material having a napped surface on which napped polyester fibers are present on one side or both sides is obtained.

The napped artificial leather base material may be further subjected to a shrinkage processing treatment or a flexibilizing treatment by crumpling to adjust the texture, or a finishing treatment such as a reverse seal brushing treatment, an antifouling treatment, a hydrophilization treatment, a lubricant treatment, a softener treatment, an antioxidant treatment, an ultraviolet absorber treatment, a fluorescent agent treatment and a flame retardant treatment.

Optionally, the polyester fibers or the napped artificial leather base material may be dyed. As the dye, a suitable dye is selected as appropriate according to the type of the fibers. Preferably, the polyester fibers are dyed, for example, with a disperse dye or a cation dye. Specific examples of the disperse dye include benzene azo-based dyes (e.g., monoazo and disazo), heterocyclic azo-based dyes (e.g., thiazole azo, benzothiazole azo, quinoline azo, pyridine azo, imidazole azo, and thiophene azo), anthraquinone-based dyes, and condensate-based dyes (e.g., quinophthalone, styryl, and coumarin). These are commercially available as dyes with the prefix "Disperse", for example. These may be used alone or in a combination of two or more. As the dyeing method, it is possible to use a high-pressure jet dyeing method, a jigger dyeing method, a thermosol continuous dyeing machine method, a dyeing method using a sublimation printing process, and the like, without any particular limitation.

Preferably, the napped artificial leather according to the present embodiment has a napped surface having an arithmetic mean height (Sa), as determined by a surface roughness measurement in accordance with ISO 25178, of 30 μm or less in a grain direction.

Here, ISO 25178 (surface roughness measurement) prescribes a method for three-dimensionally measuring a surface state by using a contact or non-contact surface roughness/shape measuring machine, and the arithmetic mean height (Sa) represents the mean of absolute values of the height differences of various points relative to the mean plane of the surface. The grain direction of the napped surface is a direction in which napped fibers collapse and are laid down when the napped surface is brushed with a seal brush.

The arithmetic mean height (Sa) of the napped surface of the napped artificial leather is preferably 30 μm or less, more preferably 28 μm or less, particularly preferably 26 μm or less, in the grain direction. When the arithmetic mean height (Sa) is too large in the grain direction, the length of the freely movable polyester fibers tends to be excessively increased by the napped surface being rubbed, resulting in a nonuniform, low-quality appearance with a dry touch and density unevenness.

The apparent density of the napped artificial leather is preferably 0.4 to 0.7 g/cm$^3$, more preferably 0.45 to 0.6 g/cm$^3$, since a napped artificial leather that is well-balanced in fullness and a flexible texture that does not cause sharp bending can be obtained. When the apparent density of the napped artificial leather is too low, sharp bending tends to occur due to the low level of fullness. Further, the polyester fibers tend to be easily pulled out by rubbing the napped surface, resulting in a low-quality, nonuniform appearance with a rough dry touch and density unevenness. On the other hand, when the apparent density of the napped artificial leather is too high, the flexible texture tends to be reduced.

EXAMPLES

Hereinafter, the present invention will be described more specifically by way of examples. It should be appreciated that the scope of the present invention is by no means limited by the examples.

First, the polyesters used in the present examples will be described.

Polyester A: Modified polyethylene terephthalate that is a copolymer including 6 mol % of an isophthalic acid unit Polyester B: Modified polyester that is a copolymer including 13 mol % of an isophthalic acid unit and 87 mol % of a terephthalic acid unit as acid-based monomer units, and 44 mol % of a butane diol unit and 56 mol % of a hexane diol unit as diol-based monomer units Polyester C: Modified polyethylene terephthalate that is a copolymer including 1.2 mol % of a dibutyl phosphate unit The evaluation methods used in the present examples will be collectively described below.

<Young's Modulus>

The Young's modulus was measured in accordance with "8.11 Initial tensile resistance" of "Chemical staple fiber testing method" of JIS-L1013, and the apparent Young's modulus was calculated.

<Fiber-Toughness Measurement>

A plurality of island-in-the-sea composite fibers that had been spun in the examples were attached with cellophane adhesive tape to the surface of a polyester film in a state in which the fibers were slightly loosened. Then, the sea component was removed by extraction by immersing the island-in-the-sea composite fibers in hot water at 95° C. for 30 minutes or more, thereby obtaining ultrafine fibers. Next, the polyester film to which the ultrafine fibers had been fixed was dyed with a disperse dye using a Pot dyeing machine at 120° C. for 40 minutes, to obtain dyed fibers. Then, the elongation was measured with an autograph while a bundle of the ultrafine fibers corresponding to a single island-in-the-sea composite fiber from among the dyed fibers were bound, and the elongation of the fiber bundle of the ultrafine fibers was measured with the autograph. Then, the breaking strength and the breaking elongation were read from the peak top of the obtained SS curve, and the fiber-toughness was calculated from the equation: Dyed fiber-toughness (cN·%)=Breaking strength (cN)×Breaking elongation (%)/Number of ultrafine fibers.

<Crystallinity Measurement>

Using a differential scanning calorimeter DSC-60A (manufactured by SHIMADZU CORPORATION), the quantity of heat of fusion ΔH(kJ/g) of a test piece cut out from the dyed napped artificial leather was measured at a temperature rising rate of 40° C./min, and the crystallinity was calculated by the following equation, using the quantity of heat of fusion 26.9 kJ/mol of a fully crystallized PET (Polymer Data Handbook).

$$\text{Crystallinity}=\Delta H/26.9\ (\text{kJ/g})/192\ (\text{g/mol})\times 100(\%)$$

<Measurement of Compressive Force of Polyester Fibers>

The same polyesters for forming polyester fibers as those used for production of the island-in-the-sea composite fibers that had been spun in the examples as an island component, and a water-soluble thermoplastic polyvinyl alcohol resin (PVA) as a sea component were discharged from a multi-component fiber melt spinning spinneret (number of islands: 12 islands/fiber) at 260° C. such that the sea component/island component was 50/50 (mass ratio), thus spinning island-in-the-sea composite fibers having a fineness of 173 dtex (24 filaments). Then, 60 sets of the island-in-the-sea composite fibers each having 24 filaments were bundled. Then, the sea component of the bundles of 60 sets of the island-in-the-sea composite fibers was extracted, to give bundles of ultrafine fibers, which were further dyed with a disperse dye using a Pot dyeing machine at 120° C. for 40 minutes. Then, four bundles of the obtained ultrafine fibers (69120 polyester fibers) were stacked, and twisted three times, and, thereafter, the compressive force was measured with a digital force gage AD-4932A-50N (manufactured by A & D Company, Ltd.) when the side surface was pushed in by 1.0 mm.

<Measurement of Surface State of Napped Surface>

The surface state of the napped surface of the napped artificial leather was measured in accordance with ISO 25178 (surface roughness measurement), using "One-Shot 3D Measuring Macroscope VR-3200" (manufactured by KEYENCE CORPORATION), which was a non-contact surface roughness/shape tester. Specifically, the napped surface of the napped artificial leather was brushed with a seal brush in the grain direction. For a range of 18 mm×24 mm of the brushed napped surface, distorted fringe projection images were captured using a 4 mega-pixel monochrome C-MOS camera at a magnification of 12× under structured illumination light emitted from a high-intensity LED, and the arithmetic mean height (Sa) was determined. Note that the grain direction was a direction in which the napped fibers lying down. The measurement was carried out three times, and the average values thereof were used as the numerical values.

<Tear Strength>

Test pieces each having a length of 10 cm and a width of 4 cm were cut out from the napped artificial leather. Then, at the center of the short side of each test piece, a 5 cm-cut was formed parallel to the longer side. Then, using a tensile tester, each of the cut pieces was sandwiched by the chuck of the jig, and the s-s curve was measured at a tensile speed of 10 cm/min.

A value obtained by dividing the maximum load by the basis weight of the test piece determined in advance was determined as a tear strength per mm. There values were determined for each test piece in the longitudinal direction of the original fabric and a transverse direction perpendicular to the longitudinal direction, and the average value was obtained for each test piece.

<Texture>

The state of the angled edge formed when the napped artificial leather was grabbed with both hands to form a bent portion was visually checked, and the sound produced when the napped artificial leather was rubbed was also checked. Then, grading was performed according to the following criteria:

Grade 5: The bent portion was gently bent, but the bending curve was slightly smaller. When rubbed, the napped artificial leather did not produce a sound (clip-clop sound) that caused vibrations in the ambient air by bending.

Grade 4: The bent portion was bent neither at a sharp angle nor in a gentle state. When rubbed, the napped artificial leather hardly produced a clip-clop sound.

Grade 3: The bent portion was gently bent, and had no angled edge. When rubbed, the napped artificial leather did not produce a clip-clop sound at all. However, the napped artificial leather was too soft and had poor shape stability, exhibiting poor mechanical properties.

Grade 2: The state in which a sharply bent projection was formed (sharp bending) was observed at the bent portion. When rubbed, the napped artificial leather produced a clip-clop sound.

Grade 1: The state in which a large projection sharply bending was formed (sharp bending) was observed at the bent portion. When rubbed, the napped artificial leather produced a loud clip-clop sound.

Example 1

A polyester including 90 mass % of polyester A and 10 mass % of polyester B as an island component and a water-soluble thermoplastic polyvinyl alcohol-based resin (PVA) as a sea component were discharged from a multi-component fiber melt-spinning spinneret (number of islands: 12 islands/fiber) at 260° C. such that the sea component/island component was 50/50 (mass ratio), thus obtaining island-in-the-sea composite fibers having a fineness of 173 dtex (24 filaments). Then, the island-in-the-sea composite fibers were crimped, and thereafter cut into staples having a length of 51 mm. The resulting staples were passed through a carding machine, to form a web. Then, sheets of the web were stacked by cross wrapping to have a total basis weight of 510 g/m$^2$, to form a superposed body, and an oil for preventing the needle from breaking was applied to the superposed body. Then, the superposed body was entangled by being needle-punched using 1-barb 42-gauge needles at 3700 punch/cm$^2$ such that the area shrinkage was 38.7%, thereby obtaining a web entangled sheet having a basis weight of 820 g/m$^2$. Then, the web entangled sheet was subjected to a steam treatment under the conditions of 110° C. and 23.5% RH, and dried in an oven at 90 to 110° C. Thereafter, the web entangled sheet was further subjected to hot pressing at 115° C., thereby obtaining a heat-shrunk web entangled sheet having a basis weight of 1346 g/m$^2$, an apparent density of 0.748 g/cm$^3$, and a thickness of 1.80 mm.

Next, the heat-shrunk web entangled sheet was impregnated with an emulsion (solid content 15%) of a polyurethane at a pick up of 50%. Note that the polyurethane was a polycarbonate-based non-yellowing polyurethane. To the emulsion were further added 4.9 parts by mass of a carbodiimide-based crosslinking agent and 6.4 parts by mass of ammonium sulfate, per 100 parts by mass of the polyurethane, and the content ratio of the polyurethane contained in the non-woven fabric was adjusted to 13%. The polyurethane formed a cross-linked structure by being heat-treated. Then, the heat-shrunk web entangled sheet that had been impregnated with the emulsion was dried under the conditions of 115° C. and 25% RH, and was further dried at 150° C. Next, the web entangled sheet to which the polyurethane had been applied was immersed in hot water at 95° C. for 10 minutes while being subjected to nipping and high-pressure water jetting, to remove the PVA by dissolution, and was further dried, to obtain a sheet including a non-woven fabric to which the polyurethane had been applied. Then, the sheet was sliced, and both surfaces of the sliced piece were ground, using a paper with a grid number of 120 for the back surface, and a paper with a grid number of 320 for the front surface, thus obtaining a napped artificial leather base material. Then, using a disperse dye, the napped artificial leather base material was subjected to high-pressure dyeing at 120° C. Then, the dyed napped artificial leather base material was hot-pressed at 120° C., to obtain a napped artificial leather having a basis weight of 572 g/m$^2$, an apparent density of 0.544 g/cm$^3$, and a thickness of 1.05 mm.

The napped artificial leather thus obtained included a non-woven fabric of polyester fibers having an average fineness of 0.36 dtex, and had a fiber-toughness of 9.9 cN·%, a Young's modulus of 3.8 GPa, and a crystallinity of 26.3%. The compressive force of 69120 fibers of the polyester fibers was as small as 3.0 N. The texture of the napped artificial leather was of grade 5, which was a flexible texture with no sharp bending, without causing any sharp bending or forming any projection when the napped artificial leather was bent. An elegant appearance with short fibers was achieved, with the surface having a roughness with an arithmetic mean height of 23.7 μm. The results are shown in Table 1.

TABLE 1

| | Example No. | | | | | | | | |
|---|---|---|---|---|---|---|---|---|---|
| | 1 | 2 | 3 | 4 | 5 | Com. Ex. 1 | Com. Ex. 2 | Com. Ex. 3 | Com. Ex. 4 |
| Polyester resin A | 90 | 95 | 67 | 80 | 95 | 84 | 99 | 100 | 100 |
| Polyester resin B | 10 | 5 | — | — | 5 | 16 | 1 | — | — |
| Polyester resin C | — | — | 33 | 20 | — | — | — | — | — |
| Average fineness (dtex) | 0.36 | 0.368 | 0.38 | 0.34 | 0.54 | 0.35 | 0.37 | 0.37 | 0.76 |
| Young's modulus (GPa) | 3.8 | 5.7 | 1.4 | 2.3 | 5.1 | 3.6 | 6.1 | 4.9 | 4.8 |
| Fiber-toughness (cN · %) | 9.9 | 25.2 | 11.8 | 17.7 | 37.5 | 7.3 | 25.0 | 20.0 | 41.1 |
| Crystallinity (%) | 26.3 | 34.2 | 34.1 | 33.3 | 34.6 | 21 | 35.0 | 36.8 | 36.5 |
| Compressive force of polyester fibers (N) | 3.0 | 9.3 | 3.5 | 7.2 | 13.4 | 2.2 | 16.1 | 17.8 | 34.4 |
| Arithmetic mean height (Sa) | 23.7 | 29.1 | 24.3 | 20.2 | 29.8 | 22.6 | 28.3 | 27.5 | 32 |
| Tear strength/longitudinal (kg) | 6.0 | 8.7 | 7.1 | 8.7 | 8.3 | 3.9 | 9.8 | 9.9 | 9.5 |
| Tear strength/transverse (kg) | 6.4 | 7.1 | 6.1 | 7.1 | 7.6 | 4.5 | 8.7 | 9.2 | 9.1 |
| Texture (grade) | 5 | 4 | 5 | 4 | 4 | 3 | 2 | 1 | 1 |

Example 2

A napped artificial leather was obtained and evaluated in the same manner as in Example 1 except that 95 mass % of polyester A and 5 mass % of polyester B were used in place of 90 mass % of polyester A and 10 mass % of polyester B. The napped artificial leather included a non-woven fabric of polyester fibers having an average fineness of 0.37 dtex, and had a fiber-toughness of 25.2 cN·%, a Young's modulus of 5.7 GPa, and a crystallinity of 34.2%. The compressive force of 69120 fibers of the polyester fibers was 9.3 N. The texture of the napped artificial leather was of grade 4, which was a flexible texture with no sharp bending. An elegant appearance with short fibers was achieved, with the surface having a roughness with an arithmetic mean height of 29.1 μm. The results are shown in Table 1.

Example 3

A napped artificial leather was obtained and evaluated in the same manner as in Example 1 except that 67 mass % of polyester A and 33 mass % of polyester C were used in place of 90 mass % of polyester A and 10 mass % of polyester B. The napped artificial leather included a non-woven fabric of polyester fibers having an average fineness of 0.38 dtex, and had a fiber-toughness of 11.8 cN·%, a Young's modulus of 1.4 GPa, and a crystallinity of 34.1%. The compressive force of 69120 fibers of the polyester fibers was 3.5 N. The texture of the napped artificial leather was of grade 5, which was a flexible texture with no sharp bending. An elegant appearance with short fibers was achieved, with the surface having a roughness with an arithmetic mean height of 24.3 The results are shown in Table 1.

Example 4

A napped artificial leather was obtained and evaluated in the same manner as in Example 1 except that 80 mass % of polyester A and 20 mass % of polyester C were used in place of 90 mass % of polyester A and 10 mass % of polyester B. The napped artificial leather included a non-woven fabric of polyester fibers having a fineness of 0.34 dtex, and had a fiber-toughness of 17.7 cN·%, a Young's modulus of 2.3 GPa, and a crystallinity of 33.3%. The compressive force of 69120 fibers of the polyester fibers was 7.2 N. The texture of the napped artificial leather was of grade 4, which was a flexible texture that caused no sharp bending when the napped artificial leather was bent. An elegant appearance with short fibers was achieved, with the surface having a roughness with an arithmetic mean height of 20.2 μm. The results are shown in Table 1.

Example 5

A napped artificial leather was obtained and evaluated in the same manner as in Example 1 except that 95 mass % of polyester A and 5 mass % of polyester B were used in place of 90 mass % of polyester A and 10 mass % of polyester B, and the fineness was adjusted to 0.54 dtex. The napped artificial leather had a fiber-toughness of 37.5 cN·%, a Young's modulus of 5.1 GPa, and a crystallinity of 34.6%. The compressive force of 69120 fibers of the polyester fibers was 13.4 N. The texture of the napped artificial leather was of grade 4, which was a flexible texture that formed no angled edge when the napped artificial leather was bent.

Comparative Example 1

A napped artificial leather was obtained and evaluated in the same manner as in Example 1 except that 84 mass % of polyester A and 16 mass % of polyester B were used in place of 90 mass % of polyester A and 10 mass % of polyester B. The napped artificial leather included a non-woven fabric of polyester fibers having a fineness of 0.35 dtex, and had a fiber-toughness of 7.3 cN·%, a Young's modulus of 3.6 GPa, and a crystallinity of 21%. The compressive force of 69120 fibers of the polyester fibers was 2.2 N. The texture of the napped artificial leather was of grade 3, which was a flexible texture that caused no sharp bending when the napped artificial leather was bent. An elegant appearance with short fibers was achieved, with the surface having a roughness with an arithmetic mean height of 22.6 μm. The results are shown in Table 1.

Comparative Example 2

A napped artificial leather was obtained and evaluated in the same manner as in Example 1 except that 99 mass % of polyester A and 1 mass % of polyester B were used in place of 90 mass % of polyester A and 10 mass % of polyester B. The napped artificial leather included a non-woven fabric of polyester fibers having a fineness of 0.37 dtex, and had a fiber-toughness of 25.0 cN·%, a Young's modulus of 6.1 GPa, and a crystallinity of 35%. The compressive force of 69120 fibers of the polyester fibers was 16.1 N. The texture of the napped artificial leather was of grade 2, which was a texture that caused sharp bending in which the napped artificial leather sharply bent when being bent, thus forming a small projection. The results are shown in Table 1.

Comparative Example 3

A napped artificial leather was obtained and evaluated in the same manner as in Example 1 except that 100 mass % of polyester A was used alone in place of 90 mass % of polyester A and 10 mass % of polyester B. The napped artificial leather included a non-woven fabric of polyester fibers having a fineness of 0.37 dtex, and a fiber-toughness of 20.0 cN·%, a Young's modulus of 4.9 GPa, and a crystallinity of 36.8%. The compressive force of 69120 fibers of the polyester fibers was 17.8 N. The texture of the napped artificial leather was of grade 1, which was a texture that caused sharp bending in which the napped artificial leather sharply bent when being bent, thus forming a large projection. The results are shown in Table 1.

Comparative Example 4

A napped artificial leather was obtained and evaluated in the same manner as in Example 1 except that 100 mass % of polyester A was used alone in place of 90 mass % of polyester A and 10 mass % of polyester B, and the fineness was adjusted to 0.76 dtex. The napped artificial leather had a fiber-toughness of 41.1 cN·%, a Young's modulus of 4.8 GPa, and a crystallinity of 36.5%. The compressive force of 69120 fibers of the polyester fibers was 34.4 N. The texture of the napped artificial leather was of grade 1, which was a texture that caused sharp bending in which the napped artificial leather sharply bent when being bent, thus forming a large projection. The results are shown in Table 1.

Referring to Table 1, each of the napped artificial leathers obtained in Example 1 to 4 according to the present invention did not exhibit sharp bending in which the napped artificial leather sharply bent when being bent, thus forming a large projection, and had sufficient shape stability with a texture of grade 4 or more. In addition, the polyester fibers had a low compressive force, and were flexible. On the other hand, the napped artificial leather of Comparative Example 1, for which the non-woven fabric of polyester fibers having an average fiber-toughness of less than 8 cN·% was used, did not exhibit sharp bending, but was too flexible and had poor shape stability for practical use. Further, the napped artificial leather of Comparative Example 1 had low mechanical strength, with the tear strength being decreased by 61% in the longitudinal direction and by 51% in the transverse direction, as compared with that of the napped artificial leather of Comparative Example 3, in which polyester A was used alone. The napped artificial leather of Comparative Example 2, for which the non-woven fabric of polyester fibers having a Young's modulus exceeding 6 GPa was used, caused sharp bending in which the napped artificial leather sharply bent when being bent, thus forming a small projection. The napped artificial leather of Comparative Example 3, for which the non-woven fabric of polyester fibers having a crystallinity exceeding 35% was used, caused sharp bending in which the bent portion sharply bent due to the hard polyester fibers, thus forming a large projection.

INDUSTRIAL APPLICABILITY

Polyester fibers obtained according to the present invention can be suitably used, either directly or in the form of a fiber structure such as a non-woven fabric or a woven fabric, for producing clothing, interior goods, bedding, and artificial leather. A napped artificial leather obtained according to the present invention can be suitably used as a skin material for clothing, shoes, articles of furniture, car seats, and general merchandise.

The invention claimed is:

1. A napped artificial leather, comprising:

an artificial leather base material that comprises a non-woven fabric comprising polyester fibers having a Young's modulus of 1.4 to 6 GPa, and average fiber-toughness of 8 to 40 cN %, and a crystallinity of 35% or less, and an elastic polymer contained in the voids of the non-woven fabric, wherein the polyester fibers comprise a polymer alloy resin of two or more polyesters having copolymer compositions different from each other, wherein the polymer alloy resin comprises a modified polyester comprising an isophthalic acid unit and a terephthalic acid unit as acid-based monomer units, and a butane diol unit and a hexane diol unit as diol-based monomer units, and the artificial base material has, on at least one surface thereof, a napped surface on which the polyester fibers are napped.

2. The napped artificial leather of claim 1, wherein the polyester fibers have a compressive force, as determined when 69120 fibers of the polyester fibers are compressively deformed by 1.0 mm in a compressive force measurement using a digital force gage, of 15 N or less.

3. The napped artificial leather of claim 1, wherein the napped surface has an arithmetic mean height, as determined in a surface roughness measurement in accordance with ISO 25178, of 30 μm or less in a grain direction.

4. Polyester fibers having a Young's modulus of 1.4 to 6 GPa, an average fiber-toughness of 8 to 40 cN %, and a crystallinity of 35% or less, wherein the polyester fibers comprise a polymer alloy resin of two or more polyester having copolymer compositions different from each other, wherein the polymer alloy resin comprises a modified polyester comprising an isophthalic acid unit and a terephthalic acid unit as acid-based monomer units, and a butane diol unit and a hexane diol unit as diol-based monomer units.

5. The polyester fibers of claim 4, wherein the polyester fibers have a compressive force, as determined when 69120 fibers of the polyester fibers are compressively deformed by 1.0 mm in a compressive force measurement using a digital force gage, of 15 N or less.

6. A non-woven fabric, comprising the polyester fibers of claim 4.

* * * * *